US010188210B2

(12) United States Patent
Gajowskyj

(10) Patent No.: US 10,188,210 B2
(45) Date of Patent: Jan. 29, 2019

(54) LEVELING DEVICE

(71) Applicant: Alexander I. Gajowskyj, Portland, OR (US)

(72) Inventor: Alexander I. Gajowskyj, Portland, OR (US)

( * ) Notice: Subject to any disclaimer, the term of this patent is extended or adjusted under 35 U.S.C. 154(b) by 0 days.

(21) Appl. No.: 15/097,936

(22) Filed: Apr. 13, 2016

(65) Prior Publication Data

US 2017/0295932 A1 Oct. 19, 2017

(51) Int. Cl.
*A47B 91/16* (2006.01)
*A47B 91/12* (2006.01)

(52) U.S. Cl.
CPC ..... *A47B 91/16* (2013.01); *A47B 91/12* (2013.01)

(58) Field of Classification Search
CPC ..... A47B 91/16; A47B 91/12; A47B 91/04; A47B 91/00; E06B 1/045; E06B 1/6069; E04G 21/10
USPC ..... 248/104; 52/126.1; 182/200; 16/82
See application file for complete search history.

(56) References Cited

U.S. PATENT DOCUMENTS 1,676,284 A * 7/1928 Powell ..... E05C 17/54 292/342
4,073,454 A * 2/1978 Sauber ..... B23Q 1/54 248/188.2
4,830,320 A * 5/1989 Bellows ..... A47B 91/12 248/188.2
5,711,560 A * 1/1998 Gilbertson ..... E05C 17/54 292/343
5,743,506 A * 4/1998 Adams ..... A47B 91/00 248/346.11
5,823,488 A * 10/1998 Nettekoven ..... A47B 21/0371 248/118
6,230,446 B1 * 5/2001 Chalich ..... E06B 1/6069 16/17.1
7,040,461 B2 * 5/2006 Chrisco ..... B60T 3/00 188/32
7,520,483 B2 * 4/2009 Rand ..... A47G 7/02 248/346.06
7,784,751 B1 * 8/2010 Bellows ..... A47B 91/02 248/188.2
2007/0271731 A1 * 11/2007 Fuller ..... E05F 5/06 16/82

(Continued)

*Primary Examiner* — Christopher Garft
(74) *Attorney, Agent, or Firm* — Miller Nash Graham & Dunn LLP

(57) ABSTRACT

The described leveling device includes a substantially planar bottom surface that intersects a substantially constantly sloped top surface at a front portion to form a substantially wedge shaped device. The front portion of the device may include a non-linear profile. The top surface may include a zone of increased friction configured to receive at least a portion of an object to be leveled. The bottom surface may include at least one continuous channel spanning from side-to-side of the leveling device. The leveling device may also include a contoured depression on a top surface and a matching contoured depression on the bottom surface. The contoured protrusion of one leveling device is configured to mechanically engage the contoured depression of another leveling device when the leveling devices are stacked, thereby interlocking the two leveling device and preventing motion of one leveling device in relation to the other leveling device.

14 Claims, 7 Drawing Sheets

(56) References Cited

U.S. PATENT DOCUMENTS

| | | | | |
|---|---|---|---|---|
| 2008/0179470 | A1* | 7/2008 | Dabrowski | F16M 7/00<br>248/188.2 |
| 2015/0289649 | A1* | 10/2015 | Perrin | A47B 91/12<br>248/346.06 |

* cited by examiner

LEVELING DEVICE

BACKGROUND

Objects, such as tables and other pieces of furniture, can often be or become unlevel. To restore levelness and stability to the object, wedges or inclined planes are often used to raise a low side or portion of the object until it becomes level with the rest of the object.

In the case of tables, especially those located in restaurants and bars, the leveling process may be a regular occurrence and is often time consuming. Often times folded pieces of paper or coasters are used to level the tables out of necessity and convenience. These improvised leveling devices are often unsightly and unstable. Further, in such locations as restaurants and bars, liquids are often spilled, such patron's drinks or water when cleaning the floor. Once these improvised leveling devices get wet, they often deteriorate, requiring replacement and removal of the remnants of the previous device.

While other wedges can be used to level tables and objects, these too are often unsightly and are typically oversized for use in leveling an object such as a table. The oversized nature means these wedges are often in the way of patrons and are easily dislodged from underneath the tables. Further, the unsightly nature of the such wedges can create a perception of low quality of the establishment in the minds of the patrons.

Embodiments of the invention address these and other limitations of the prior art.

DETAILED DESCRIPTION

Figure 1:
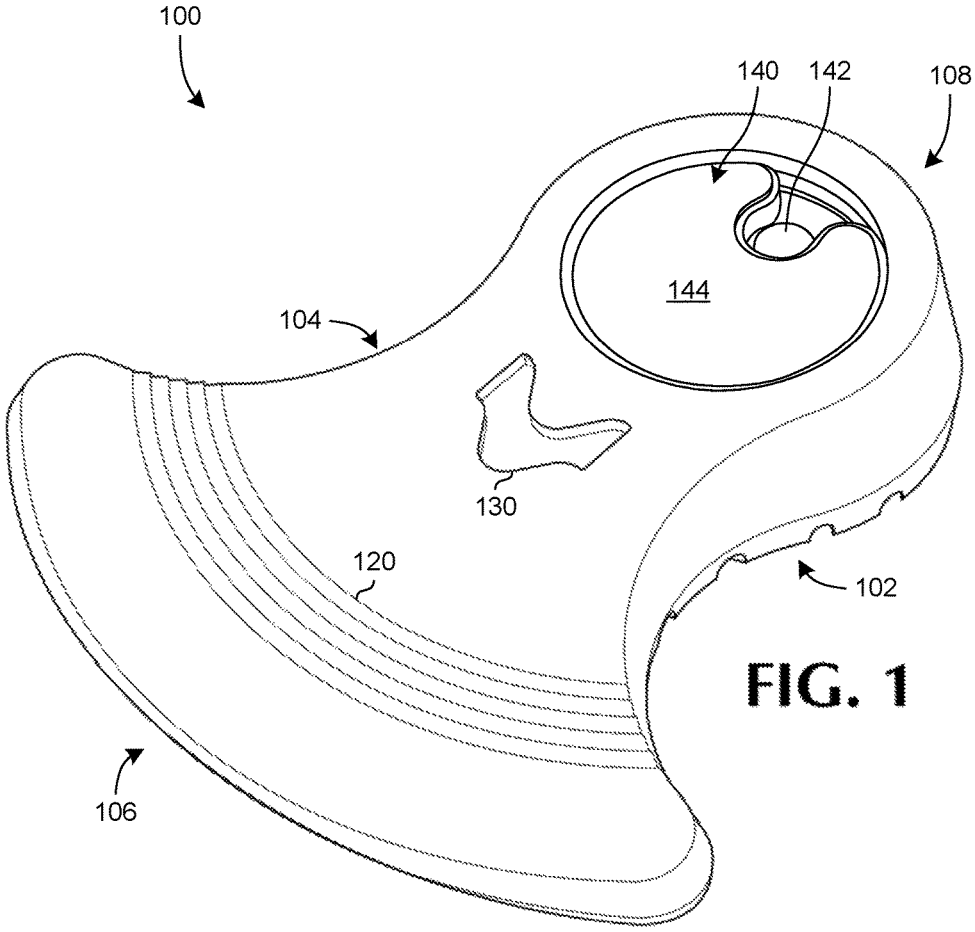
FIG. 1 is a top perspective view of an example leveling device according to embodiments of the invention.

FIGS. 1-7 illustrates an example generally wedge-shaped leveling device 100 according to embodiments of the invention. The illustrated leveling device 100 includes a bottom surface 102, a top surface 104, a front portion 106 and a rear portion 108. The bottom surface 102 is substantially planar and the top surface 104 has a substantially constant slope. The top surface 104 and bottom surface 102 intersect at the front portion 106 and are separated at the rear portion 108 by a rear surface. Since the rear portion has a greater height than does the front portion, the leveling device 100 is generally wedge-shaped.

Figure 2:
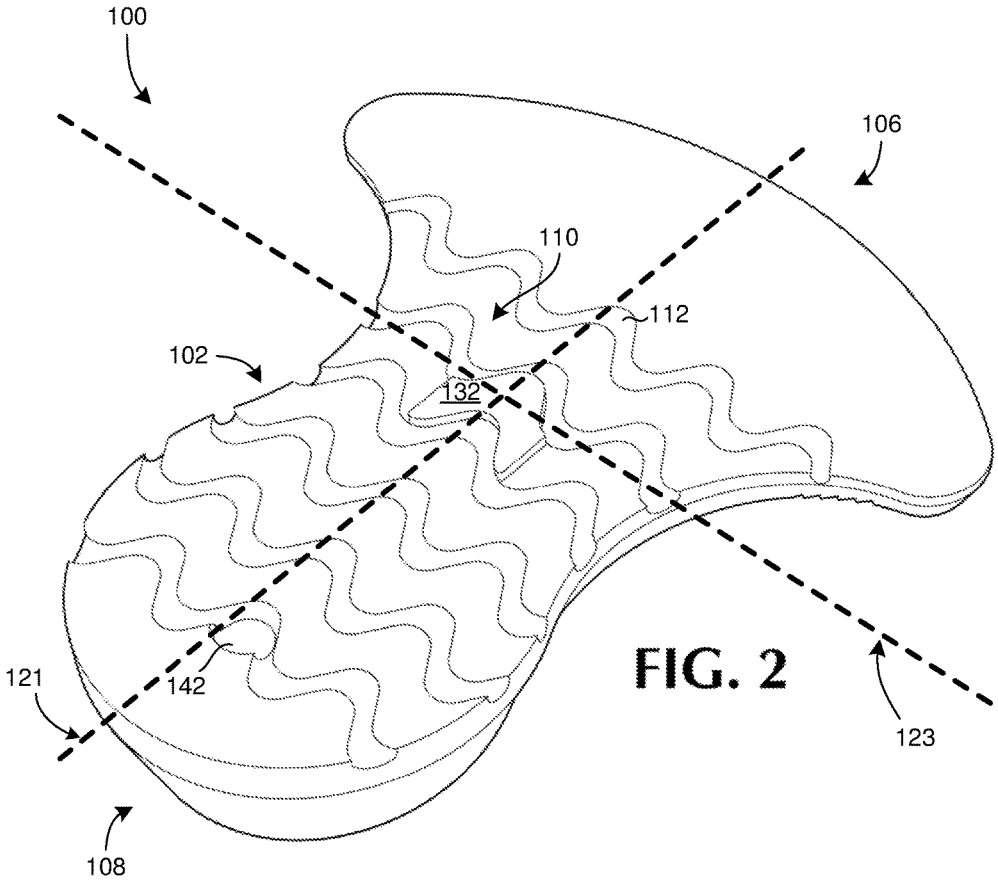
FIG. 2 is a bottom perspective view of the leveling device of FIG. 1.
Figure 3:
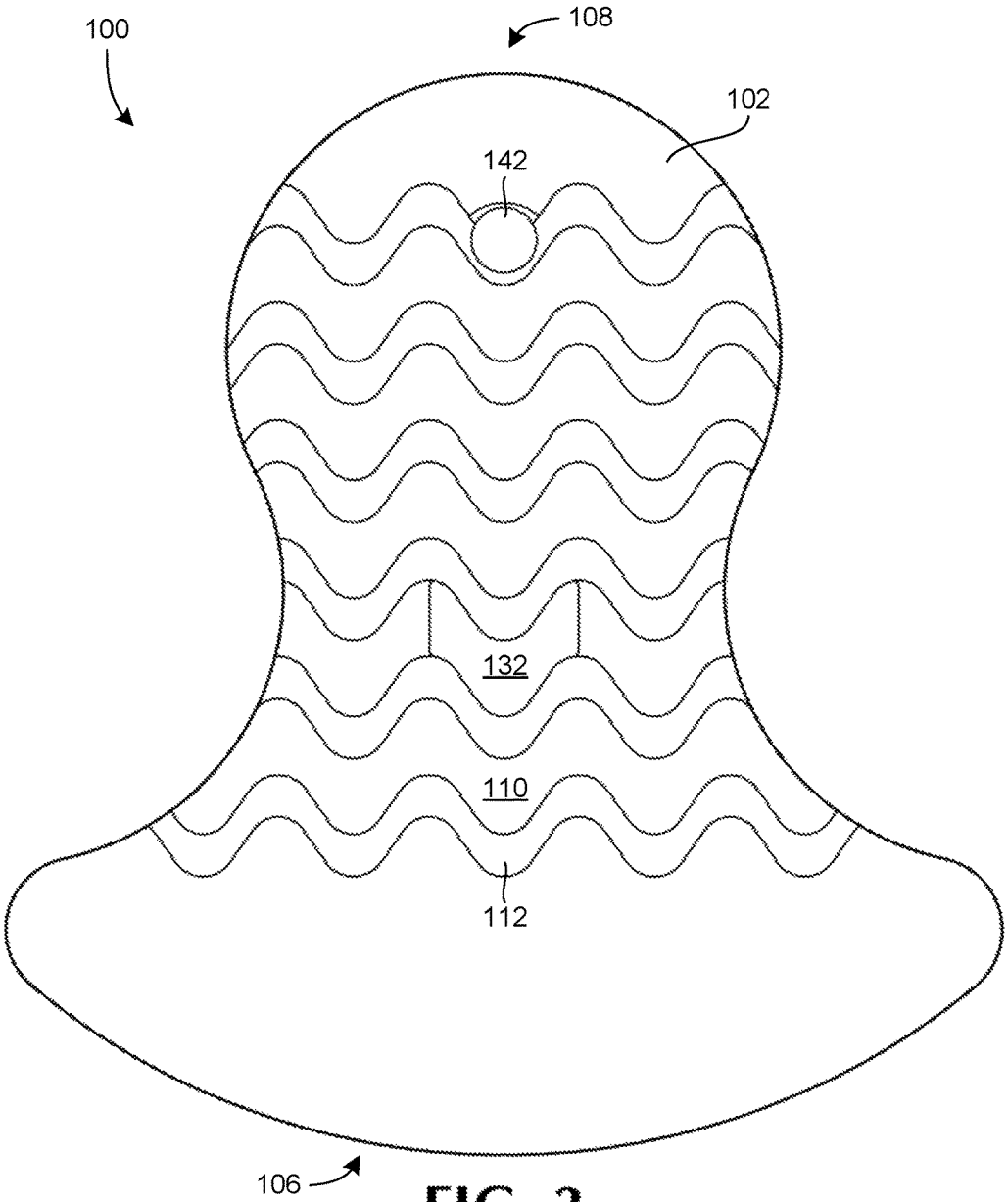
FIG. 3 is a bottom view of the leveling device of FIG. 1.
Figure 4:
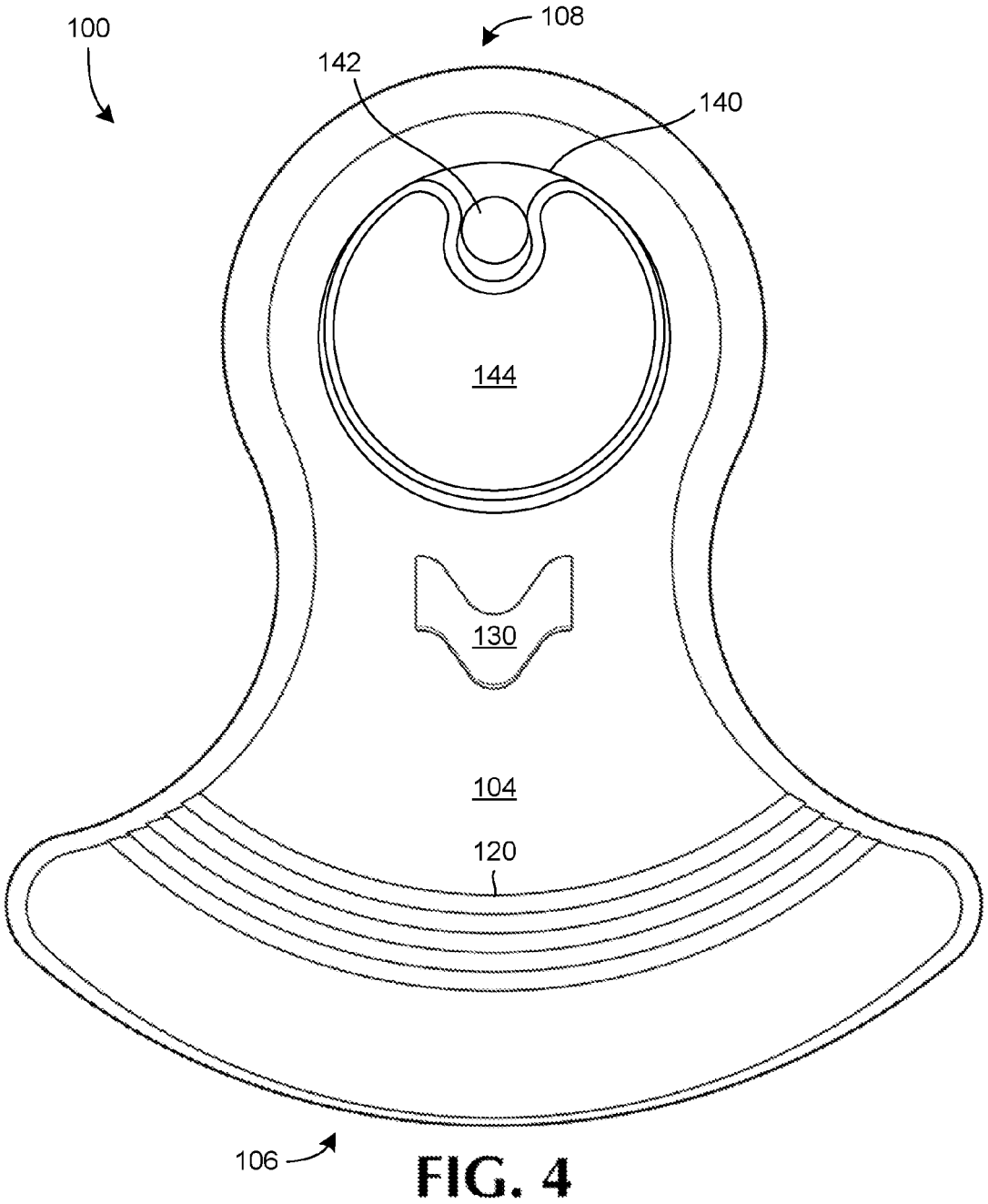
FIG. 4 is a top view of the leveling device of FIG. 1.
Figure 5:
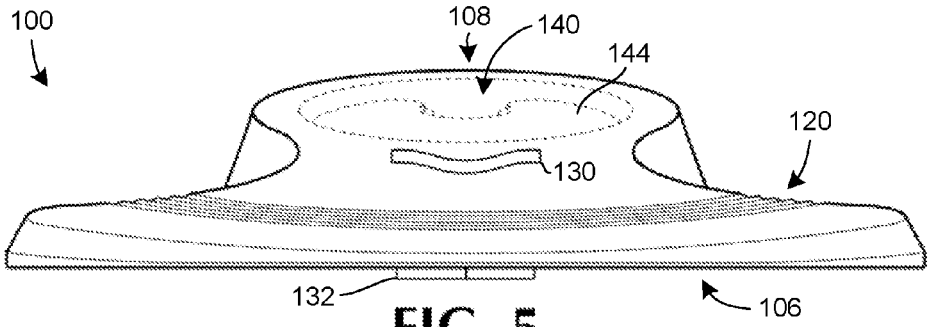
FIG. 5 is a front elevation view of the leveling device of FIG. 1.
Figure 6:
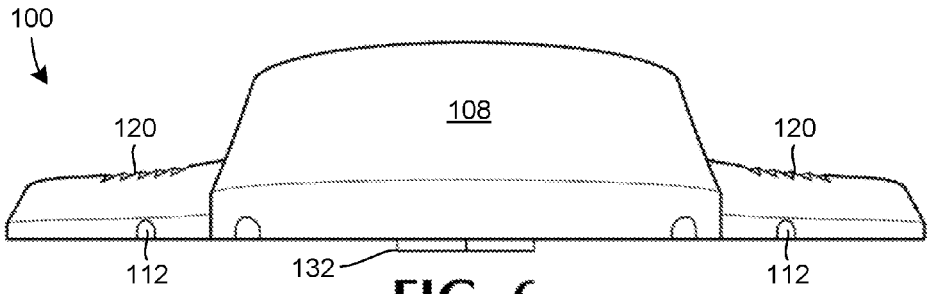
FIG. 6 is a rear elevation view of the leveling device of FIG. 1.
Figure 7:
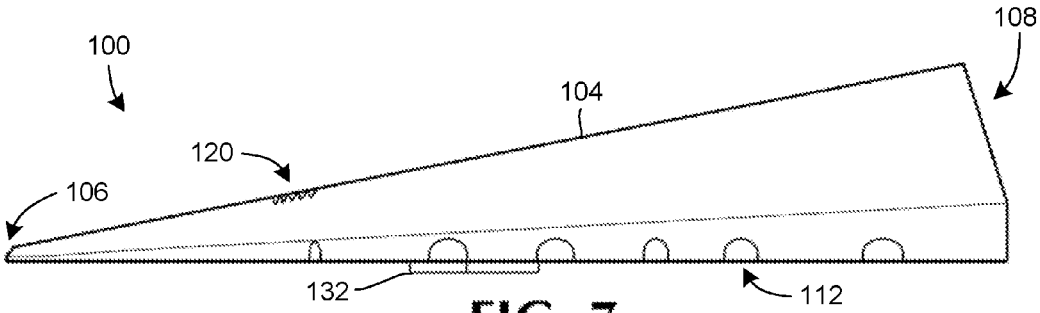
FIG. 7 is a side elevation view of the leveling device of FIG. 1.

The bottom surface 102, as detailed in FIGS. 2 and 3, may include an integrally formed pattern, or tread, 110. The pattern 110 can be repeated across a portion or all of the bottom surface 102. The design of the pattern 110 can be one that considers one or both of an aesthetic or functional characteristic.

The pattern 110 is separated by continuous channels 112 that span a width of the leveling device 100. When resting on a surface, the continuous channels allow liquids and air to flow through the channels from one side of the leveling device 100 to the other. The flow-through nature of the channels 112 prevents liquids from pooling on either lateral side of the leveling device 100. Of course, although serpentine channels 112 are illustrated in FIGS. 2 and 3, the channels may have different profiles or patterns and vary in number than those illustrated by 112. For example, the channels may be straight, angled, or have fewer curves in them than as illustrated in FIGS. 2 and 3. In one particular embodiment there may be 1-5 straight channels 112 spanning the entire width of the leveling device 100.

The front portion 106 of the leveling device 100 has a non-linear profile to assist with insertion and leveling of an object using the leveling device 100. In the example shown, the front portion 106 has a curved profile that is defined by a constant radius. The constant radius profile is mirrored across a centerline that bisects the leveling device 100 lengthwise and having an origin of the radius located along said centerline. The sweep, side-to-side, of the radius from the origin defines the front portion 106 of the leveling device 100. In alternative embodiments, the curved profile of the front portion 106 can be defined by a non-constant radius curve or a curve having an origin located elsewhere on the device. Further the front profile may include a compound curve or other alternative non-linear profile. As illustrated best in FIG. 5, the front portion 106 may appear to have a generally dished profile when viewed from the front.

In the embodiment shown in FIGS. 1-7, the front portion 106 is flared, resulting in an overall width of the front portion 106, wider than a main body portion of the leveling device 100. In alternative embodiments, the degree of the flare, or width, of the front portion 106 can be varied based on preference and/or design and use criteria. In alternative embodiments, the overall width of the front portion 106 can be substantially the same as the width of the device 100, with the front portion 106 lacking a flared end.

The top surface 104 includes a number of shallow grooves 120 formed thereon, the shallow grooves 120 forming an area of increased friction on the top surface 104. In the example embodiment shown in FIGS. 1 and 4-7, the grooves 120 are disposed in arced profiles across the top surface 104. The arced profiles of the grooves 120 are constant radius and share a similar origin as the constant radius forming the illustrated front portion 106. The shallow grooves 120 can increase friction of the top surface 104 to assist with the adhesion, or grip, between the top surface 104 and an object being leveled using the leveling device 100. In some embodiments the number of shallow grooves 120 is between 1 and 10, and more preferably between 4 and 7.

In alternative embodiments, the shallow grooves 120 can have alternative profiles, such as a linear profile, a zig-zag profile, a wavy profile or a custom profile, such as a logo or emblem, as desired. In other embodiments, the grooves 120 may instead be a pattern of raised areas formed in the top surface 104. In further embodiments, the grooves 120 may instead be an alternative material, i.e., a material different than that making up the body of the device 100, having increased friction properties. The alternative material can be permanently or releaseably affixed to the leveling device 100 in the area of the grooves 120 and can include a pattern or texture to further alter the friction of the material. In yet other embodiments, no grooves 120 may appear or be disposed on the top surface 104.

In some embodiments, a contoured depression 130 is included on the top surface 104 of the leveling device 100. In the example embodiment shown in FIGS. 1 and 4-7, the contoured depression 130 is disposed substantially centrally of the leveling device 100. The contoured depression 130 is shaped and configured to accept a contoured protrusion 132 that projects from the bottom surface 102, shown in FIGS. 2-3 and 5-7, as described in more detail below. In FIG. 2, the contoured protrusion 132 is located approximately at an intersection of a first midline axis 121 and a transverse midline axis 123.

The contoured protrusion 132 of a first leveling device 100 is structured to mechanically engage the contoured depression 130 of a second leveling device 100, thus interlocking the first and second leveling devices. The interlocking of the leveling devices allows two or more devices to be stacked atop one another during use. Stacked, interlocked leveling devices 100 allow for a greater leveling capacity. That is, the increased height, due to the stacked, interlocked nature, allows the unit of multiple devices to raise an object a greater height than a single leveling device 100 used alone. Additionally, the interlocking increases the safety of using multiple stacked leveling devices 100, as the interlocking prevents the leveling devices from slipping or moving relative to each other once stacked.

In alternative embodiments, the leveling device 100 may lack a contoured depression 130 and a contoured protrusion 132. Multiple devices 100 could still be stacked atop each other, although there would not be a mechanical engagement with one another by means of a mating depression and protrusion. Friction between the stacked devices can be sufficient to engage and hold the stacked device together, especially when pressed together by the force of the table or whatever the stacked devices 100 were being used to level. The friction between the devices can be increased by the continuous channels 112 on the bottom surface 102, the shallow grooves 120 on the top surface 104 and the material used to construct the leveling device 100. In combination, the elements listed above can generate enough friction to securely interlock stacked leveling devices during use.

An optional recess 140 can be included on the leveling device 100. In the embodiment shown, the recess 140 is disposed proximally to the rear portion 108 of the device 100. The recess 140 has a depth from the top surface 104 and can be substantially parallel relative to the surface on which the leveling device 100 is placed, can be contoured to match the slope of the top surface 104 or at any other contour so designated.

An opening 142 can be included in the recess 140, the opening passing from a lower surface of the recess 140 through the bottom surface 102 of the leveling device 100. The opening 142 can be used to hang the leveling device 100 for storage and serves to drain any liquid that accumulates in the recess 140. Further, a peg or rod can be inserted through the openings 142 of multiple leveling device 100 in a stacked configuration to further aid in the interlocking nature of the stacked devices. The opening 142 may also accept a keyring and the leveling device could be thereby attached to the keyring and kept together with keys. In operation, the user could remove the leveling device 100 from the keyring and place under a table, or other object to be leveled. Or, the user may choose to leave the leveling device 100 attached to his or her keys, which may help the user remember to take the leveling device after the leveling is no longer needed.

The recess 140 can be configured to accept a removable token 144. The token 144 can include branding, marketing, a message, a design or other visual media that is visible to a person viewing the leveling device 100. The token 144 can be removed and replaced as desired by a user or other to change the message or design displayed. The profile of the token 144 can be substantially flat, such that the token 144 rests against and parallel to the lower surface of the recess 140. Alternatively, the token 144 can be profiled to follow the slope of the top surface 104, such that when inserted, the profile of the token 144 is substantially that of the top surface 104.

A slot can be disposed about the periphery of the recess 140, extending a depth into the surrounding portion of the leveling device 100. The slot configured to interlock about a flanged or rimmed portion of the token 144, thereby retaining the token 144 within the recess 140.

In the example embodiment illustrated, the token 144 is shown having a substantially flat profile. In alternative embodiments, the surface profile of the token 144 can have a three-dimensional profile, such as a raised design, relief, or structure that is affixed to and extends away from the surface of the token 144. Conversely, the token 144 can include a depressed design, sunken relief, or structure that extends below the surface of the token 144. Also, the surface profile of the token 144 can include a combination of both relief and sunken relief design.

A notch can be included in the token 144 to ensure the opening 142 is not obscured or blocked by the token when placed in the recess 140. Alternatively, the token 144 can be solid so as to obscure the opening 142 as desired.

The token 144 can be composed of a similar material as the leveling device 100 or can be of an alternate composition. In an embodiment, the token can be made of metal, hard polymer such as plastic, a soft polymer such as rubber, a paper based material such as cardboard or other suitable or desirable material. The material can be selected based on the desired longevity of the token 144, the design of the token 144, the environment the leveling device 100 and token 144 will be placed in and other design and aesthetic considerations.

In an example embodiment, the leveling device 100 can have an overall length of approximately 30-70 mm and preferably between approximately 55-66 mm measured from the front portion 106 to the rear portion 108. The rear portion may be curved as well, and have a height of between approximately 5-20 mm, and preferably approximately 10-13 mm. The front portion 106 is defined by a curve having a constant radius of, for example, approximately 20-50 mm, and preferably 36-44 mm, with an overall width of approximately 10-100 mm, and preferably between 50-60 mm. The contoured depression 130 has a depth of 1 mm from the top surface 104 and the contoured protrusion extends 0.75 mm from the bottom surface 102. The recess 140 has a diameter of 18-22 mm and the token 144 includes an outer flange having a diameter of 20-24 mm that interfaces with the slot about the inner periphery of the recess 140. The opening 142 has a diameter of 3-4 mm and the token 144 can include a similarly sized notch so as not to obscure the opening 142 when the token 144 is placed within the recess 140.

The leveling device 100 is preferably constructed of a durable, resilient, semi-flexible material such as a polymer. In the example embodiment illustrated herein, the leveling device 100 is constructed of hard, rubber-like material that is cast or injected into a form. The entire leveling device 100 can be cast or molded with all features included or a basic design can be cast and further machined, sculpted, or sintered to form the remaining features or elements.

Alternative, suitable materials can be used to construct the leveling device 100 and its features. The material selected based on various design criteria and use variables, such as the weight of the object being levelled, aesthetic appeal, and the environment in which the leveling device 100 will be placed or used. Alternative materials can include plastics, rubbers, metals, carbon or cellulose fibers, or composites.

In a further alternative embodiment, the leveling device 100 can be bi-material, that is, the leveling device 100 being constructed of two or more materials. In an embodiment, the lower surface 102 can be constructed of a softer material configured to provide increased grip or adhesion between the leveling device 100 and a surface it is placed upon. While the top surface 104, including the front portion 106, are constructed of a stiffer, more durable material that can support the weight of the object being levelled.

In a further example embodiment, the reverse may be true, with the bottom surface 102 being constructed of a harder, more durable material than the top surface 104 and front portion 106. Such an embodiment may be preferable for environments in which the lower surface 102 leveling device 100 may be subjected to harsh environments, such as corrosive chemicals. In such an embodiment, the surface 102 would be resistant to corrosion, with the included channels 112 allowing the fluid to pass safely beneath the leveling device 100. The top surface 104 is constructed of a softer, more pliable material in order to increase the adhesion or grip between the leveling device 100 and the object being levelled. Further, the use of a more pliable material for the top surface 104 can assist with minimizing the amount of environmental vibration transmitted through the leveling device 100 into the object supported thereon.

Additionally, the material used to construct the leveling device 100 is one that is preferably machine or otherwise washable. Use of such a material allows the leveling device 100 to be quickly and easily cleaned of any accumulated detritus in order to maintain the aesthetic appearance of the leveling device 100.

Figure 8:
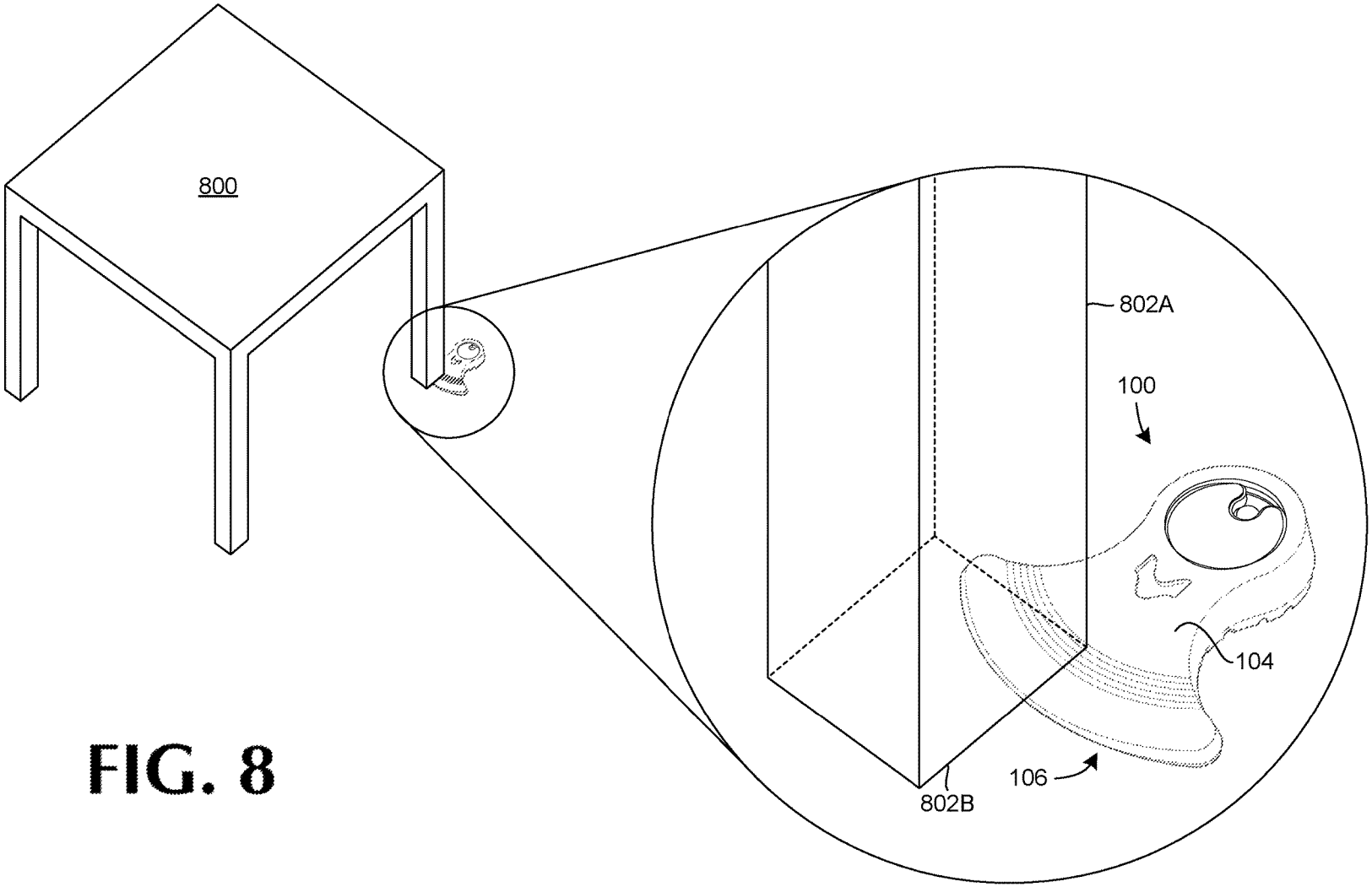
FIG. 8 is a view of the leveling device as used to level an object.

To use the leveling device 100, as described above, a user inserts the front portion 106 under a low side portion 802A of an object 800 to be levelled, as shown in FIG. 8. The leveling device 100 is inserted beneath the object such that the low side portion 802A of the object 800 rests at a point along the sloped top surface 104 such that the low side portion 802A of the object 800 is raised level with the rest of the object. In certain situations, multiple leveling devices 100 may be used about multiple low portions 802A, 802B of the object 800 to be leveled, in order to level the object as desired.

In an example embodiment in which the object to be leveled contains multiple leveling points, such as a table having multiple legs, multiple leveling devices 100 can be used, in single or stacked configurations, with the multiple leveling points. One or more legs of the table can have a leveling device 100 used to support the leg(s) and level the table.

The flared nature of the front portion 106 can assist with positioning the leveling device beneath the object 800 to be leveled. The wide front portion 106 can make it easier to insert the leveling device 100 beneath a supporting structure or portion 802A of the object 800. For example, the leveling device 100 may be twisted or turned while under the object 800 to be leveled to secure engagement with the object 100. Further, the wide front portion 106 provides stability while the object is being levelled as the object 800 is less likely to slip off the leveling device 100.

Additionally, the constant slope nature of the top surface 104 intersecting with the curved front portion 106 provides a system of coarse and fine level adjustment. The intersection forms a concavity across the front portion 106 of the leveling device 100. The user can roughly level an object 800 on a centerline of the leveling device 100. Then, by rotating the leveling device 100 beneath the object 800, the object 800 follows the curve of the front portion 106. In doing so, the object 800 is moved more slowly up the slope of the top surface 104 than if the object 800 were merely slid lengthwise directly along the top surface 104.

As discussed above, multiple leveling devices 100 can be stacked and interlocked together to achieve the necessary height required to level an object. The interlocking nature of the leveling devices 100 by the contoured depression 130 and contoured protrusion 132 secures the multiple leveling devices into a single unit that can be used to level an object. The contoured depression 130 of a first leveling device 100 mechanically engages the contoured protrusion of a second leveling device 100, thereby interlocking the two leveling devices into a single unit. The unit of stacked leveling devices can then be inserted beneath a low side of an object to level it. Since the unit consists of multiple stacked leveling devices, the overall height of the unit is increased, allowing the unit to raise a low side of an object higher than would otherwise be possible with a single device. If required, more leveling devices can be stacked and interlocked to achieve the desired or required height needed to level or raise an object.

Figure 9C:
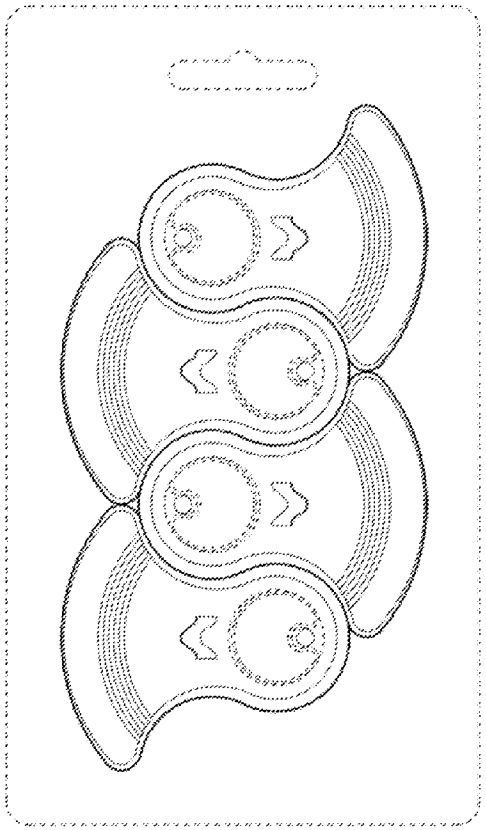
FIGS. 9A-9C illustrate example packaging arrangements of multiple leveling devices, such as that of FIG. 1.
Figure 9B:
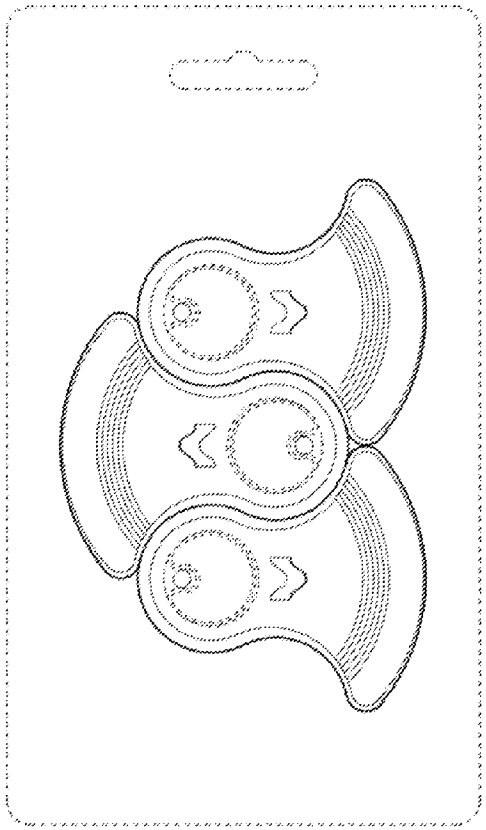
Figure 9A:
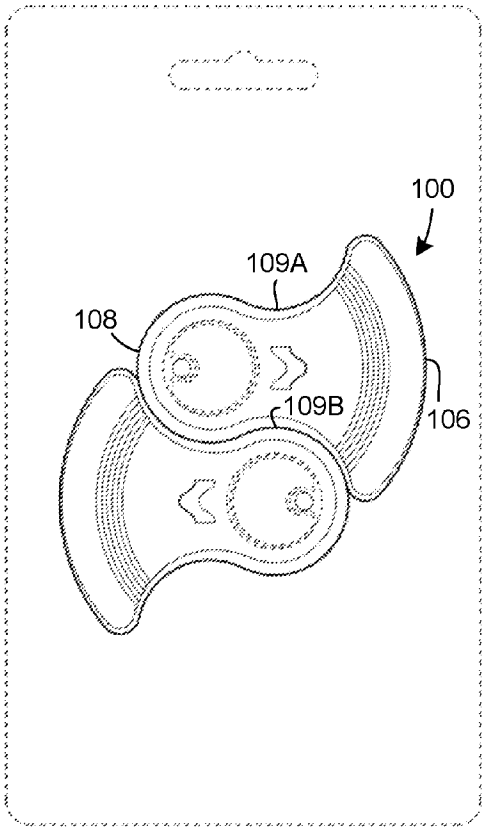

FIGS. 9A-9C illustrate various packaging arrangements of the leveling device 100. Due to the overall shape and profile of the leveling device 100, multiple devices are able to be tessellated for increased packaging efficiency. Such an arrangement is achieved by the curved rear portion 108 and its relation to the profiled sides 109A and 109B and the constant radius of the front portion 106 of the device 100. The curvature of the rear portion 108 is configured to follow the curvature of the profiled sides 109A and 109B of the leveling device 100. The outermost portions of the constant radius front portion 106 are configured to not extend past a midpoint of a leveling device placed oppositely alongside, as shown in FIGS. 9A-9C. The ability to tessellate multiple leveling devices 100, as shown, increase the packaging efficiency of the leveling devices 100.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A generally wedge shaped leveling device having a first midline axis and a transverse midline axis that perpendicularly intersects the first midline axis at approximately a middle of the first midline axis, the leveling device comprising:

a top surface having a substantially constant slope relative to a bottom surface;

the bottom surface being substantially planar other than a relatively small, singular, central protrusion of the bottom surface located at an intersection of the first midline axis and the transverse midline axis, the central protrusion extending a first distance from the bottom surface in a direction away from the top surface; and a rear surface connecting the top surface to the bottom surface at a rear end thereof; and an integrally formed pattern disposed on the bottom surface, the formed pattern having at least one continuous channel spanning between a first edge of the bottom surface and a second edge opposite the first edge of the bottom surface.

2. The leveling device of claim 1, in which a front end of the bottom surface has a curved edge profile.

3. The leveling device of claim 2, wherein the curved edge has an approximate constant radius.

4. The leveling device of claim 1, further including a contoured depression disposed in a center portion of the top surface.

5. The leveling device of claim 1, further including a recess disposed proximal to the rear surface, the recess configured to receive a removable token.

6. The leveling device of claim 5, further including an opening disposed within the recess and extending through the device and the bottom surface.

7. The leveling device of claim 1, further including an area of increased friction disposed on the top surface and proximal to a front portion.

8. The leveling device of claim 7, wherein the area of increased friction includes two or more shallow grooves.

9. The leveling device of claim 8, in which the front portion of the bottom surface has a curved edge profile formed of a constant radius arc having an origin on a midline of the device, and in which the shallow grooves also have constant radius arcs having a substantially similar origin as the origin of the curved edge profile.

10. The leveling device of claim 7, wherein the leveling device is substantially made of a first material, and in which the area of increased friction is made from a second material other than the first material.

11. A portable leveling device, comprising:

a substantially planar bottom surface;

a top surface having a substantially constant slope relative to the bottom surface, the top surface intersecting the bottom surface at a front portion terminating in an arced profile defined by a constant radius curve having an origin along a longitudinal centerline of the device;

a relatively small, singular, protrusion located in the center of the bottom surface and extending in a direction away from the top surface; and an integrally formed pattern disposed on the bottom surface, the formed pattern having at least one continuous channel spanning between a first edge of the bottom surface and a second edge opposite the first edge of the bottom surface.

12. The portable leveling device according to claim 11, in which the top surface includes a plurality of shallow grooves disposed proximal the front portion of the device, the shallow grooves having a constant radius profile and having the same origin as the arced, constant radius profile of the front portion.

13. The portable leveling device according to claim 11, in which the protrusion extends 0.75 mm from the bottom surface.

14. The portable leveling device of claim 11, further including a contoured depression disposed in a center portion of the top surface and sized to accept the protrusion of a second portable leveling device.

* * * * *